US006023247A

United States Patent [19]

Rodeffer

[11] Patent Number: 6,023,247

[45] **Date of Patent: *Feb. 8, 2000**

[54] SATELLITE DISH ANTENNA STABILIZER PLATFORM

[75] Inventor: Charles Eugene Rodeffer, Burlington, Iowa

[73] Assignee: Winegard Company, Burlington, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 08/801,360

[22] Filed: Feb. 19, 1997

[51] Int. Cl.[7] ..... H01Q 1/34; H01Q 3/08

[52] U.S. Cl. ..... 343/765; 343/766; 343/882

[58] Field of Search ..... 343/709, 713, 343/765, 766, 882; H01Q 1/32, 1/34, 3/08

[56] References Cited

U.S. PATENT DOCUMENTS

| | | | |
|---|---|---|---|
| 3,355,954 | 12/1967 | Levine et al. | 74/5.34 |
| 3,599,495 | 8/1971 | Brown et al. | 74/5.34 |
| 3,999,184 | 12/1976 | Fuss, III | 343/709 |
| 4,197,548 | 4/1980 | Smith et al. | 343/765 |
| 4,209,789 | 6/1980 | Snedkerud | 343/765 |
| 4,586,050 | 4/1986 | Kuroda et al. | 342/426 |
| 4,821,047 | 4/1989 | Williams | 343/882 |
| 5,153,485 | 10/1992 | Yamada et al. | 343/766 |
| 5,223,845 | 6/1993 | Eguchi | 342/359 |
| 5,227,806 | 7/1993 | Eguchi | 343/765 |

FOREIGN PATENT DOCUMENTS 9423469 10/1994 WIPO .

*Primary Examiner*—Michael C. Wimer

*Attorney, Agent, or Firm*—Dorr, Carson, Sloan & Birney, P.C.

[57] ABSTRACT

A stabilizer platform mounted to a vessel for positioning a satellite dish antenna in the azimuth and elevation directions. An azimuth motor and an elevation motor are mounted in a formed hollow interior of a housing. Azimuth motor control cables and elevation motor control cables are connected to the motors to carry signals and power for controlling the operation of the motors. On top of housing is mounted a platform which rotates in the azimuth direction with respect to the housing. The azimuth motor is coupled to the platform through a gear arrangement and rotates the platform. On top of the platform is mounted an elevation drive which holds the satellite dish antenna. Mounted in the platform is an elevation gear cluster which rotates with respect to the platform. The elevation gear cluster is coupled to the elevation drive. The elevation motor drives the elevation gear cluster so that the elevation motor can move the satellite dish antenna in the elevation direction. The satellite dish antenna can be rapidly positioned in both the azimuth and elevation directions, independently of each other, without the elevation motor control cables or the azimuth control cables becoming entangled or moving.

12 Claims, 10 Drawing Sheets

160
80
70
50
60
68
62
66
64
110
834
780
102
792
810
140
830
834
730
795
790
744
782
784
740
792
742
710
760
910
900
802
860
130
352
54
710
930
798
880
350
324
312
313
40
750
120
100
110
38
39
720
360
330
940
730
322
332
920
370
303
302
102
310
300
30
34
81
311
36
12
14
301
36
32
20
36
14
301
31
311
81
20

SATELLITE DISH ANTENNA STABILIZER PLATFORM

BACKGROUND OF THE INVENTION

1. Field of the Invention

The present invention relates to a stabilizer platform for a moving object such as a vehicle or a vessel and, more particularly, to a stabilizer platform carrying a satellite dish antenna wherein the antenna is continuously pointed at a target satellite by controlling only the azimuth and elevation of the antenna to compensate for movement of the vessel.

2. Statement of the Problem

The popularity of programming received from a satellite has significantly increased over the past decade. Today, digital programming is being delivered by a number of different companies using satellites to transmit signals to earth-based small satellite dishes such as dishes 18 inches in diameter. In most instances, the consumers install the small satellite dish antennas at a fixed geographic site such as at their home. Some consumers install small satellite dish antennas on top of their vehicles such as a recreational vehicle. When they park the vehicle, they tune in the desired satellite.

A need exists to permit vehicles that are moving such as recreational vehicles (RVs), marine vessels and floating sea platforms to continuously lock into a target satellite even though the vehicle or vessel moves in different directions. This is accomplished by mounting a stabilizer platform providing rapid alignment between the satellite dish antenna targeted on the satellite and the moving vehicle.

Vessels pose a particular problem especially in a heavy sea. When a vessel moves in water, the direction may change (yaw), the vessel may tilt along the length (pitch), or the vessel may tilt from side to side (roll). Hence the stabilizer platform must rapidly compensate for changes in yaw, pitch and roll to maintain the small satellite dish antenna targeted on the satellite. In addition, the stabilizer platform must be capable of rapid alignment so as to maintain the integrity of the received signal from the targeted satellite.

Prior art stabilizer platforms are of many types. One mechanically simple type is the two axis mount termed the AZ-EL mount which controls the dish antenna in the azimuth (AZ) and elevation (EL) directions. Such AZ-EL mounts typically use a turntable that may be rotated about the azimuth axis and a support that can be elevated about an elevation axis. AZ-EL mounts can be quickly and accurately pointed to any target in the sky. By rapidly moving the turntable about the azimuth axis and in the elevation axis, these stabilizer systems can compensate for yaw, pitch and roll of the vessel.

A problem with AZ-EL stabilizer platforms occurs when the cables that connect to the dish antenna and to the azimuth and elevation motors wrap around components of the system during use. A need exists to have a design that eliminates this wrap problem.

A need exists for an AZ-EL stabilizer platform that has the azimuth and elevation motors mounted to the base of the stabilizer platform so as to eliminate the wrapping problem for the electrical cables.

When the control motors are placed on the moving part of the stabilizer platform, not only does it add to the weight of the moving part but often additional weight must be added to counterbalance to weight of the motors. A need exists to eliminate the added weight from the motors on the moving part and the added weight from counterbalancing.

In certain prior AZ-EL platforms, the AZ and EL driver must be activated separately. A need exists for an AZ-EL drive system wherein both drives can be activated simultaneously.

Finally, it is a goal of the present invention to provide singularity of control for the AZ and EL axes so that, for example, the stabilizer platform can be rotated through 360° turns in the same direction without wrapping of the cables.

A patentability search was directed toward the features of the present invention and this search resulted in the following patents.

The "Two Access Mount Pointing Apparatus" (published Oct. 13, 1994, as International Publication No. WO 94/23469) patent application discloses a pointing arm carrying a satellite dish antenna mounted to a universal joint supported by a base on a ship. The pointing arm is rotatably mounted within the universal joint for rotation about first and second control axes. The universal joint provides rotation of the point arm through greater than 180 degrees but less than 360 degrees about each of the first and second control axis while suffering no singularities of control.

U.S. Pat. No. 3,599,495 relates to a stabilizing platform using a three axis gimbal system including a gyroscopically stabilized platform.

U.S. Pat. No. 3,999,184 provides a platform having elevation, azimuth, roll and pitch motors. The cable control lines for the motors are designed with slack to provide elevation travel of at least 90 degrees and azimuth travel of at least 270 degrees.

U.S. Pat. No. 4,197,548 sets forth an antenna stabilizing system using three linear hydraulic actuators for pitch, yaw and roll connected on the mount. Independent elevational positioning of the antenna is provided.

U.S. Pat. No. 4,586,050 sets forth an automatic tracking system for an antenna using an electronic control connected to roll and pitch sensors for controlling the AZ and EL drives. The antenna also uses a tracking system for locking onto a satellite. The AZ and EL drives are alternatively driven.

U.S. Pat. No. 4,821,047 discloses a mechanical analog of the geosynchronous satellite arc and then forces the axis of the antenna to rotate through the geosynchronous arc.

U.S. Pat. No. 5,223,845 sets forth an AZ-EL system for controlling azimuth and elevation of an array antenna. The array antenna is pivotally supported on an azimuth axis frame by an elevation axis. The elevation axis motor is mounted on the azimuth axis fram. U.S. Pat. No. 5,227,806 is related to the aforesaid patent.

U.S. Pat. No. 3,355,954 teaches the use of three gyroscopes and motors mounted to rotating gimbals to obtain a stabilized platform.

None of the prior art approaches set forth the mounting of the elevation and azimuth motors on the non-moving support base of the stabilizer platform or deliver the signal cable through the center of the platform so as to eliminate cable wrap.

3. Solution to the Problem

The present invention provides a stabilizer platform for a satellite dish antenna that eliminates wrapping of the motor control and power lines. This is achieved without use of expensive slip rings or rotary joints. The present invention places the elevation and azimuth motors on the base of the stabilizer platform which is fixed to the surface of the vessel or vehicle. The placement of the motors on the base eliminates motor wrap with respect to the control and power cables attached to each motor. The signal cable from the satellite dish antenna is passed through the center of the stabilizer platform. The placement of the motors on the base also eliminates the requirement for use of counterweights on the moving parts of the stabilizer platform. Both the azimuth and the elevation control motors can operate on the satellite dish simultaneously.

SUMMARY OF THE INVENTION

A stabilizer platform mounted to a vessel for positioning a satellite dish antenna. The stabilizer platform of the present invention moves the satellite dish antenna only in the azimuth and elevation directions. A cylindrically shaped housing is provided that is mounted to the vessel. The housing has a formed hollow interior. An azimuth motor and an elevation motor are each mounted in the formed hollow interior of the housing. Azimuth motor control cables and elevation motor control cables are connected to the motors to carry signals and power for controlling the operation of the motors. On top of housing is mounted a platform which rotates with respect to the housing which is fixed to the vessel. The platform rotates in the azimuth direction. The azimuth motor is coupled to the platform through a gear arrangement and rotates the platform about the housing in the azimuth direction. On top of the platform is mounted an elevation drive. The elevation drive holds the satellite dish antenna. Mounted in the platform is an elevation gear cluster which rotates with respect to the platform. The elevation gear cluster is coupled to the elevation drive. The elevation motor is mechanically coupled to the elevation gear cluster so that the elevation motor can move the satellite dish antenna in the elevation direction. The azimuth motor rotates the platform in the azimuth direction independently of the elevation motor moving the satellite dish antenna in the elevation direction. Hence, the satellite dish antenna can be rapidly positioned in both the azimuth and elevation directions without the elevation motor control cables or the azimuth control cables becoming entangled or moving.

DETAILED DESCRIPTION OF THE INVENTION

1. Overview

Figures 1, 12:
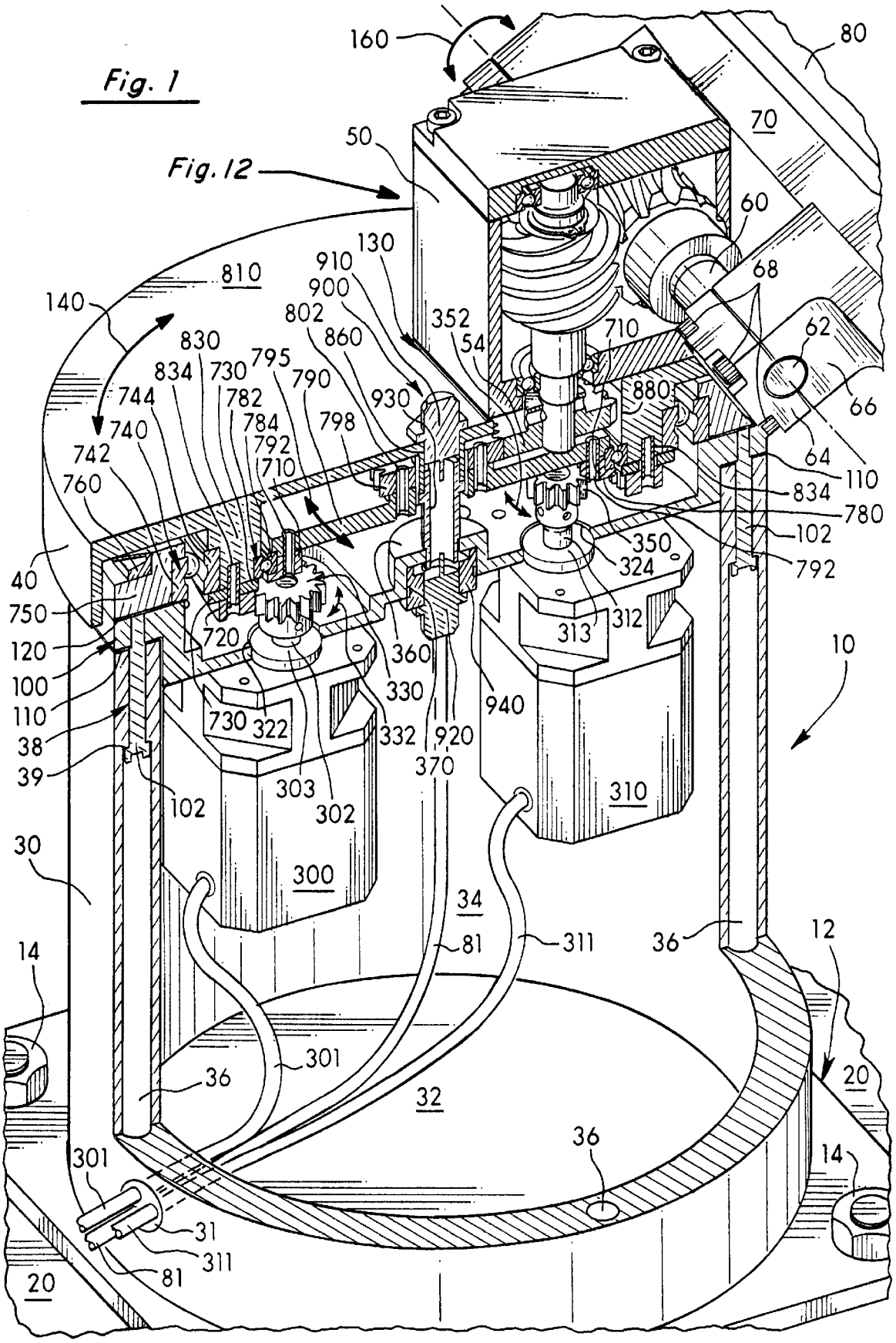
FIG. 1 sets forth a cut-away perspective of the major components of the stabilizer platform of the present invention.
FIG. 12 is a cut-away perspective view of the elevation drive of the present invention.
Figure 11:
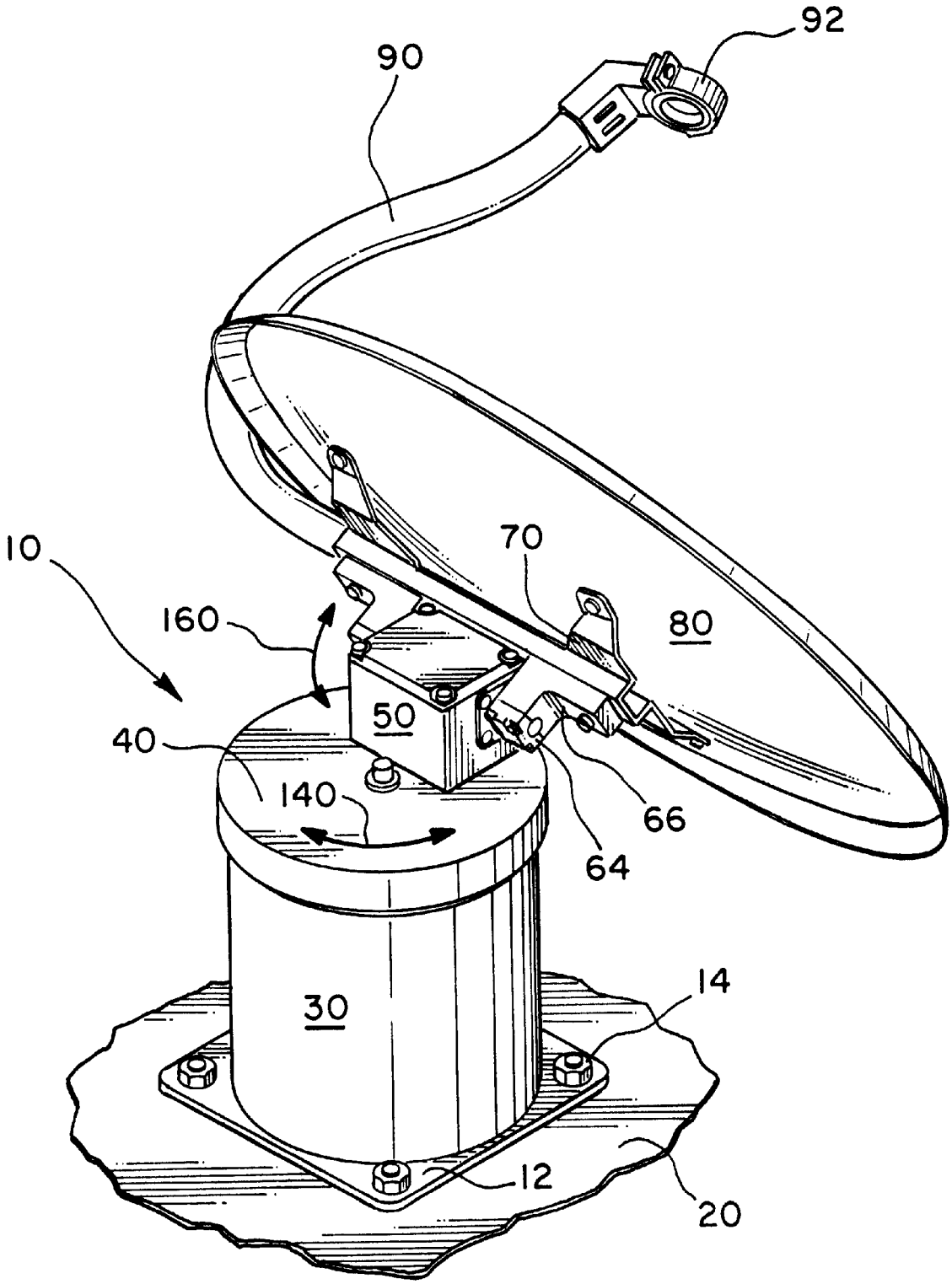
FIG. 11 is a perspective of the stabilizer platform of the present invention.
Figure 12:
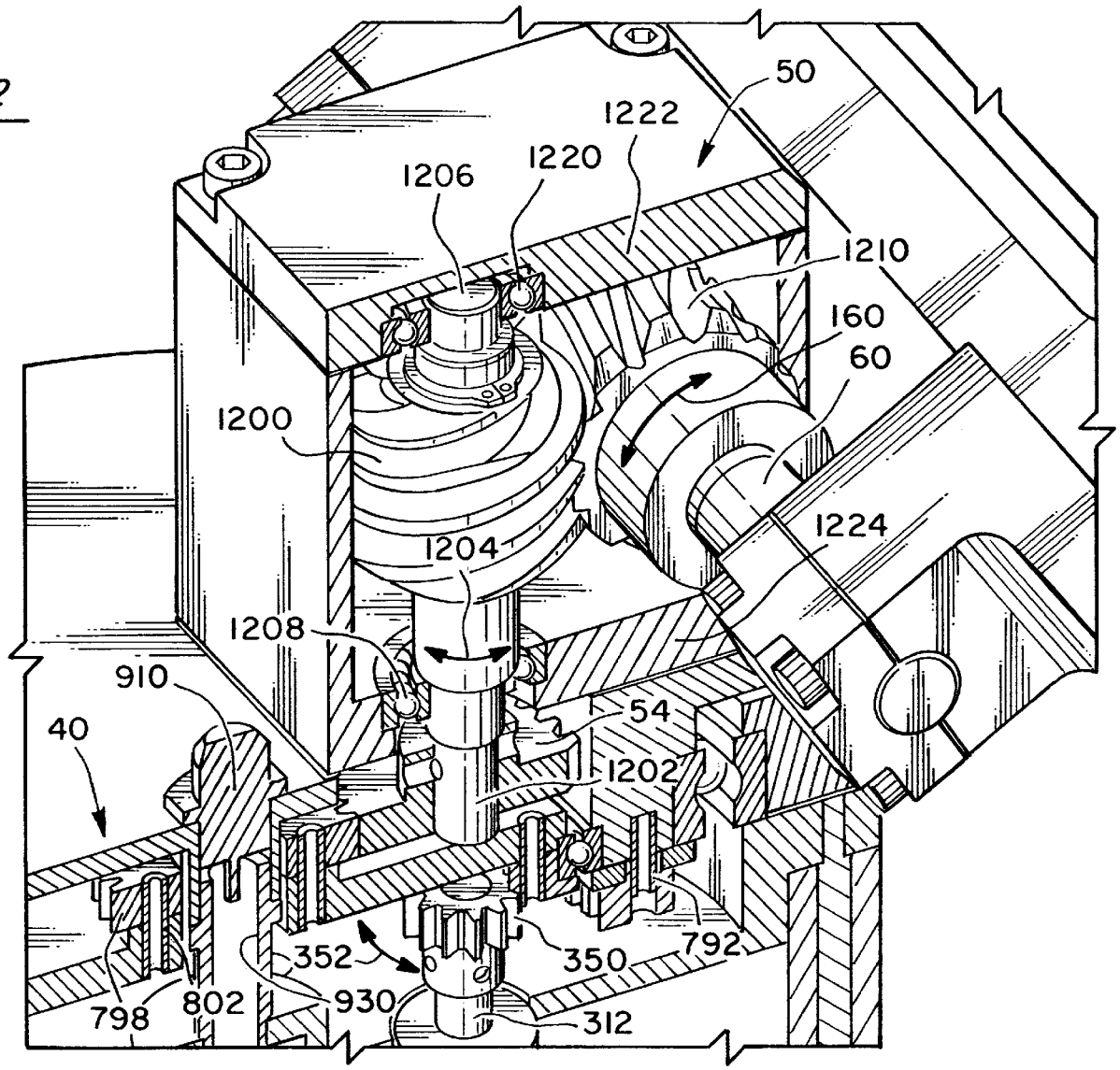
Figure 13:
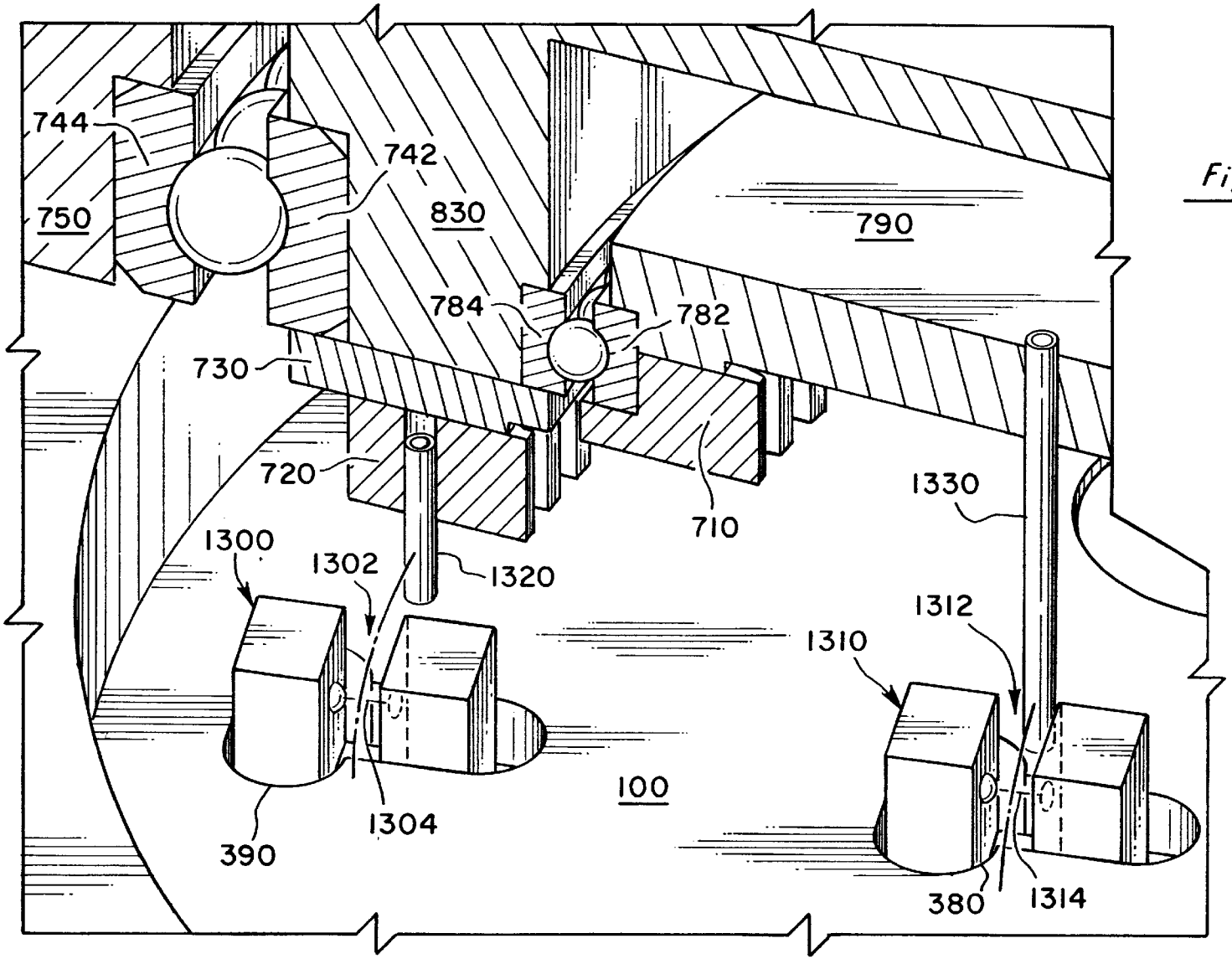

In FIGS. 1 and 11, the major components of the stabilizer platform system 10 of the present invention are disclosed for positioning a satellite dish antenna 80. The stabilizer system 10 is mounted to a vessel 20. The stabilizer system 10 has a base plate 12 which is secured by means of connectors 14 or the like to the vessel 20. It is to be expressly understood that the vessel 20 could be a surface on a vehicle or other moving object to which it is desired to affix the stabilizer platform system 10 of the present invention. The term "vessel" is used for convenience throughout the specification but is to be broadly interpreted to mean a moving object such as a recreational vehicle, a truck, a train, a boat, a ship, or the like. The stabilizer platform system 10 of the present invention continually positions the satellite dish to a target satellite while the vessel moves.

The stabilizer platform 10 has mounted to the base plate 12 a tubular housing 30. On top of the tubular housing 30 is a platform 40. On top of the platform 40 is mounted a worm gear drive 50. Through the worm gear drive 50 is disposed a shaft 60 which extends outwardly in ends 62 on opposing sides of the worm gear drive 50. On these outwardly extending and opposing ends 62 of shaft 60 is fixed a cap 64 and an L-mount 66. The cap 64 is firmly connected to the L-mount 66 by means of suitable connectors 68. The engagement of the cap 64 to the L-mount 66 and to the shaft 60 is such that the L-mount 66 and cap 64 rotates with the rotation of shaft 60. The L-mount 66, in turn, is connected to a bracket 70 which is mounted to the rear of the satellite dish 80 by suitable connectors 72. The feed support arm 90 is mounted through the interior of the bracket 70. The end 92 of the feed support arm 90 carries a conventional feed, not shown.

The design of cap 64, L-mount 66, bracket 70 and feed support arm 90, as well as the dish 80, is immaterial to the teachings of the present invention. The present invention relates to a novel stabilizer platform 10 to which any suitable satellite dish antenna 80 could be mounted to the outwardly extending ends 62 of shaft 60. Indeed, any suitable device or object (such as dish 80) that needs to be pointed in a desired direction could be mounted to ends 62. Likewise, the shape and configuration of the base plate 12, the tubular housing 30, or the platform 40 are not critical to the teachings of the present invention although a circular shape for the platform 40 and the tubular housing 30 is most suitable to the implementation of the stabilizer platform 10 as will be further explained. The base plate 12 can be connected to the tubular housing 30 in any suitable fashion such as by means of bolts affixing through plate 20 to the bottom of the tube housing 30 (not shown) or by welding or any other suitable connector.

With reference to FIGS. 1 and 11, the stabilizer platform 10 of the present invention is mounted to a moving object 20 for positioning a satellite dish antenna 80 in the azimuth 140 and elevation 160 directions. The stabilizer platform 10 of the present invention includes an azimuth motor 300 which is mounted to the housing 30 and which in turn is mounted to the vessel 20. In essence, the azimuth motor 300 is mounted to the moving object 20. Likewise, the elevation motor 310 is also mounted to the moving object 20. In the preferred embodiment, these motors 300 and 310 are mounted to the interior 32 of the cylindrically shaped housing 30. It is to be expressly understood that they could be mounted directly to the vessel 20 and exposed to the environment. Azimuth control cables 301 carry conventional signals and power for controlling the operation of the azimuth motor 300 to rotate 140 the platform 40. The elevation motor control cables 311 are connected to the elevation motor 310 and also carry conventional signals and power for controlling the operation of the elevation motor 310. The stabilizer platform 10 provides a platform 40 on top of the cylindrical housing 30 for rotating 140 in the azimuth direction. The azimuth motor 300 is mechanically coupled through a gear arrangement to the platform 40 for rotating the platform 40 in the azimuth direction 140. An elevation gear drive is rotationally mounted in the platform 40 and is mechanically coupled to the satellite dish antenna 80 to move it in the elevation direction 160. This elevation gear drive is comprised of two components. The first is the elevation worm gear drive 50 which is mounted on top of the platform 40 and is directly connected to the dish antenna 80 as shown. The second is an elevation gear cluster which is rotationally mounted in the platform 40. The elevation motor 310 is coupled to the elevation gear drive to raise and lower the satellite dish antenna 80 in the elevation direction 160. The azimuth motor 300 rotates the platform in the azimuth direction 140 independently of the elevation motor 310 moving the satellite dish antenna 80 in the elevation direction 160 so that the satellite dish antenna 80 can be rapidly positioned in both the azimuth and elevation directions 140, 160 without the elevation motor control cables 311 or the azimuth motor control cables 301 moving.

2. Stabilizer Platform Assembly

Figures 2, 13:
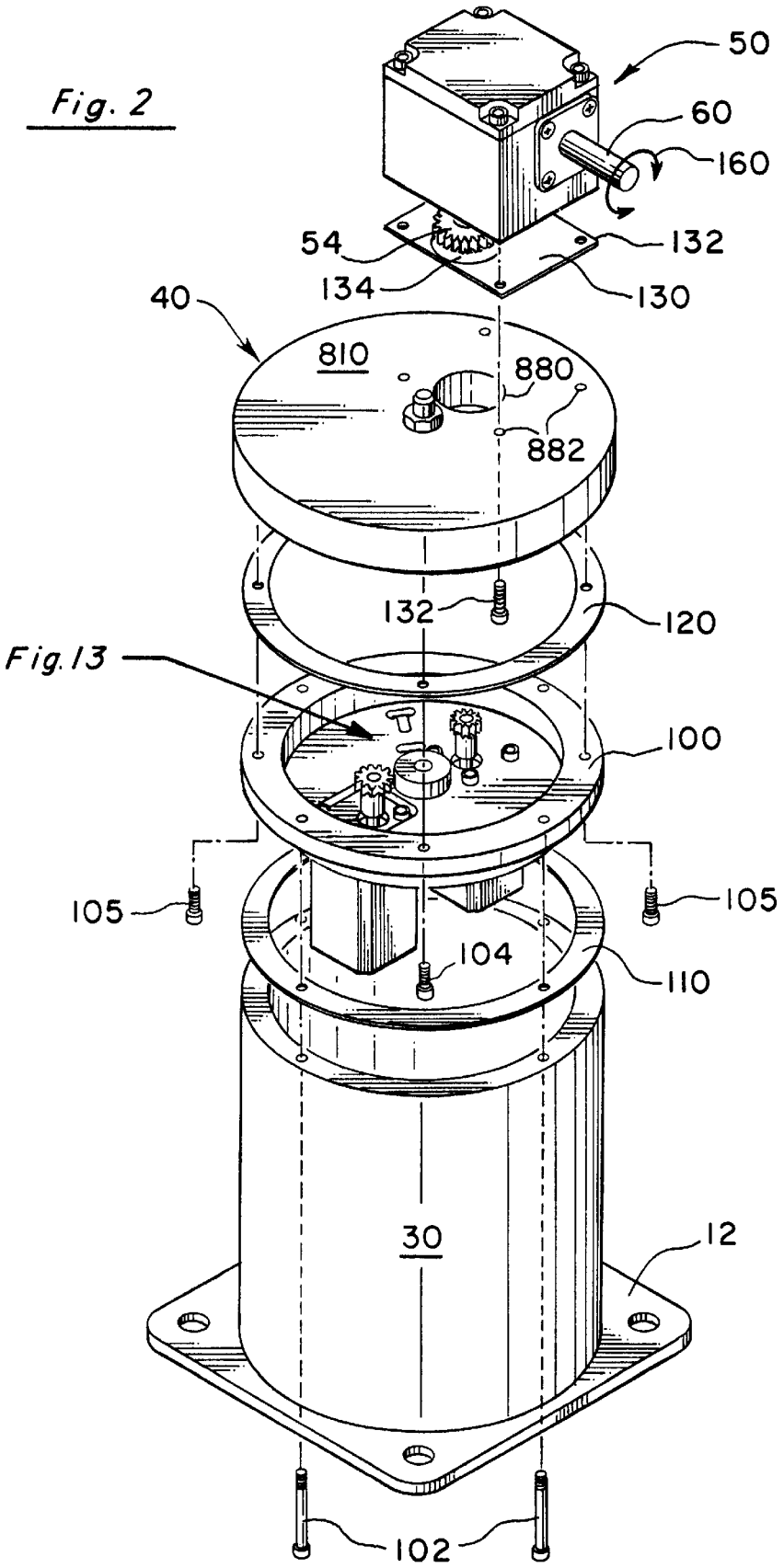
FIG. 2 sets forth an exploded view of the stabilizer platform of FIG. 1.
FIG. 13 is a perspective view of the initialization photo sensors of the present invention.

In FIGS. 1 and 2, of the assembly of the worm gear drive 50 to the platform 40 and the assembly of the platform 40 to the tubular housing 30 is shown.

The tubular housing 30 is machined from a suitable metal such as an aluminum alloy. Tubular housing 30 has a formed interior region 32 within interior side walls 34 and a plurality (such as four) of formed cylindrical passageways 36 each of which terminates in a cylindrical passageway 38 of reduced diameter as shown in FIG. 1. A shoulder 39 connects the two passageways 36 and 38.

A motor support 100 is disposed between the platform 40 and the tubular housing 30. As shown in FIG. 1, a bolt 102 is inserted into passageway 36 to abut against shoulder 39 and engage a formed hole 104 in the motor support 100. A gasket 110 is placed between the motor support 100 and the tubular housing 30 to provide a weather tight seal. In the preferred embodiment, the four passageways 36 are formed at even spacings around the tubular housing 30 and four bolts 102 are used to engage the four threaded holes 104. This firmly mounts the motor support 100 to the upper end of the tubular housing 30.

The motor support 100, in turn, is assembled to a portion of the platform 40 to be subsequently discussed. A gasket 120 is provided as a weather tight seal. The worm gear drive 50 is attached to the platform 40. A gasket 130 is placed between the worm gear drive 50 and the platform 40 and the housing 50 is affixed by means of bolts 132. It can be observed in FIGS. 1 and 2 that when the various components discussed above are connected together the gaskets 110, 120 and 130 provide a weather tight engagement so that the remaining components found within the housing 50, within the platform 40 and within the tubular housing 30 are protected from the environment.

3. Motor Support 100

In FIGS. 1, 3, and 4–6 is shown the general construction of the mounting the motors 300, 310 to the support 100. Motor 300 is the azimuth motor (AZ) and motor 310 is the elevation motor (EL). These motors are conventional stepper motors The motors 300 and 310 are mounted to the bottom 320 (FIG. 4) of the motor support 100. Azimuth motor 300 has a shaft 302 and elevation motor 310 has a shaft 312. Around each shaft is a collar 303 and 313 for motors 300 and 310 respectively. These collars 303 and 313 fit into corresponding formed openings 322 and 324 in the bottom surface 320 of support 100. Azimuth motor 300 mounts to support 100 by means of bolts 326. Elevation motor 310 mounts to support 100 by means of bolts 328. When assembled motors 300 and 310 are firmly attached to support 100 which in turn is firmly attach to tubular housing 30. Essentially, the motors 300 and 310 are fixedly mounted to the vessel 20. While the preferred embodiment shows the motors 300 and 310 mounted in the hollow interior 32 of a tubular housing 30, it is to be understood that any suitable mount to the vessel 20 could be used including directly mounting the motors to the vessel without enclosing them in a housing.

Azimuth gear 330 is connected to shaft 302 on the inside region 340 of support 100. Elevation gear 350 is connected to shaft 312 of elevation motor 310 also in the interior region 340. The gears 330 and 350 are firmly connected to shafts 302 and 312, respectively (such as by conventional keys, not shown) so that as each shaft rotates so does the connected gear. Azimuth gear 330, in the preferred embodiment, has 16 teeth and elevation gear 350 has 12 teeth. In the preferred embodiment, the gears are machined from brass.

As shown in FIG. 1, the motors 300 and 310 are mounted and protected from the external environment in the interior 34 of the tubular housing 30. Centrally located in the motor support 100 is formed an upstanding collar 360 having a formed hole 362. As will be explained, the programming signals received by the dish 80 are delivered through hole 362 and into cable 81. The control cables 301 and 311 for motors 300 and 310 are delivered from the interior 34 of housing 30 through weatherproof seal 31 to the exterior of the housing 30. It is clear from FIG. 1, that the motor support 100 is firmly mounted to the tubular housing 30, carries the motors 300 and 310, and is fixedly attached to the vessel 20. As will be explained, the platform 40 is designed to move in the azimuth direction 140 and the shaft 60 is to move in the elevation direction 160 without causing the cables 81, 301 and 311 to twist.

The azimuth motor control cables 301 and the elevation motor control cables 311 carry the necessary signals and power to control the operation of the motors 300 and 302. Such signals and power are conventional and vary according to the target seeking algorithms used.

Figures 4, 5, 6:
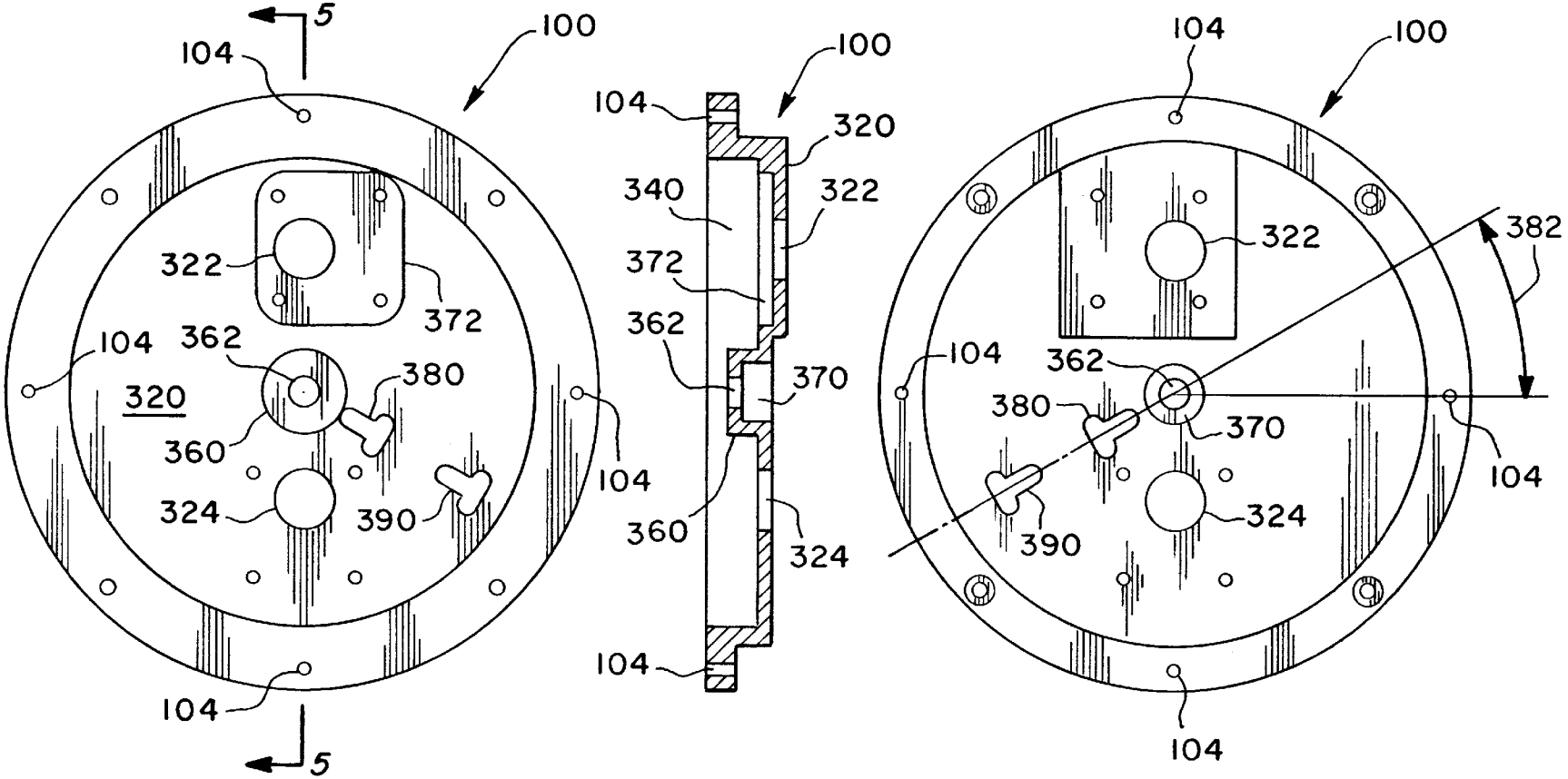
FIG. 4 shows a top planer view of the motor support of FIG. 3.
FIG. 5 is a cross-section of the motor support of FIG. 4 taken along lines 5—5.
FIG. 6 is bottom planar view of the motor support of FIG. 3.

In FIGS. 4, 5, and 6 the details of the motor support 100 are shown. An annular region 370 is formed below upstanding collar 360. The annular region 370 has a greater diameter than the diameter of the formed opening 362. A formed recess 372 exists in the interior 340 of the motor support 100 about formed hole 322 for the azimuth motor 300. A slot 390 is formed through bottom 320 for azimuth control and a slot 380 is formed in the bottom 320 for elevation control. The purpose and functions of these slots 380 and 390 will be discussed subsequently. In the preferred embodiment, these slots are located at an angle 382 of preferably 30° as shown in FIG. 6.

4. Platform Assembly 700

Figure 7A:
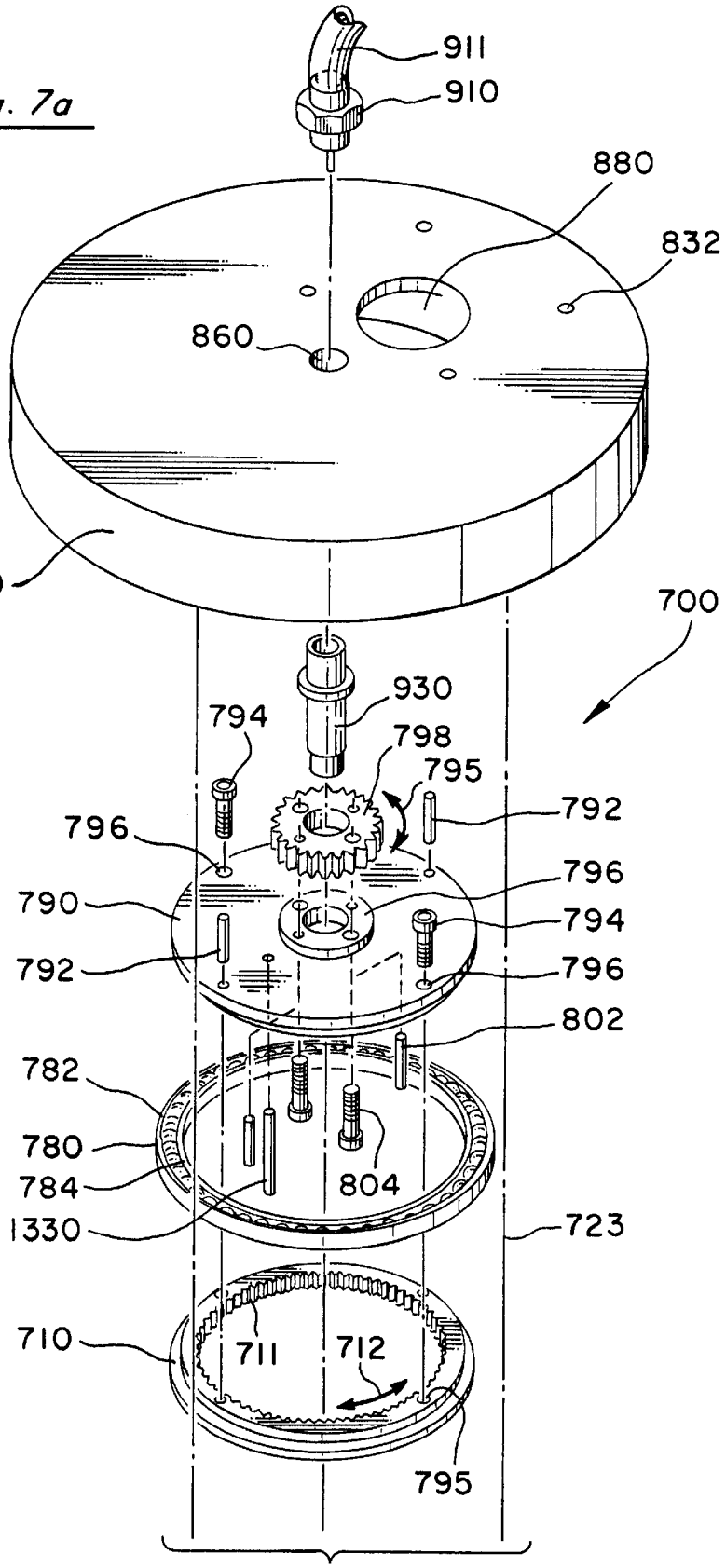
FIGS. 7*a* and 7*b* are an exploded view of the components of the platform assembly of the present invention.
Figure 7B:
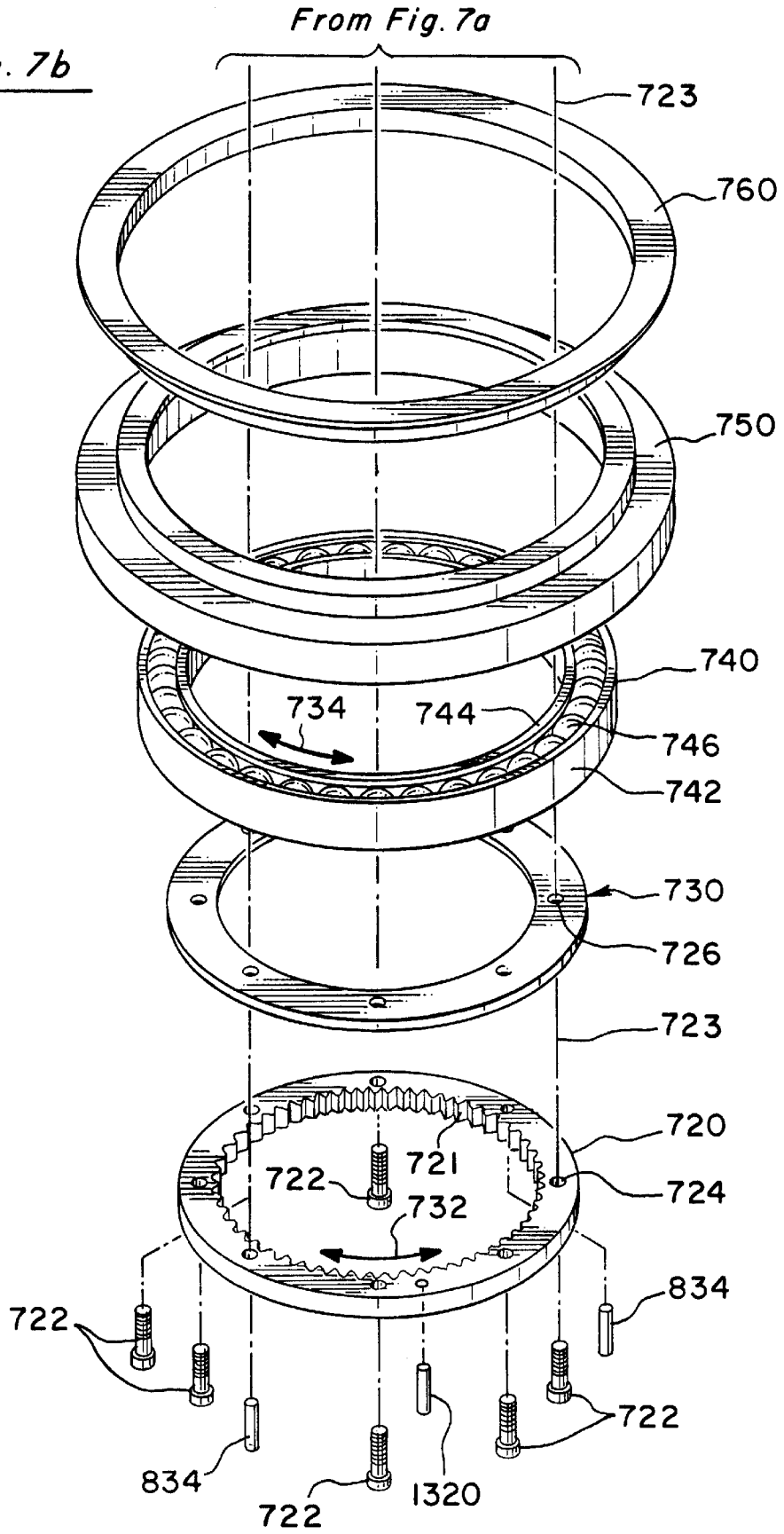

In FIGS. 7*a* and 7*b* the details of the platform assembly 700 are shown. The platform 40 contains an elevation gear 710 (FIG. 7*a*) and an azimuth gear 720 (FIG. 7*b*). The azimuth gear 720, in the preferred embodiment, has 96 teeth 721 and, as shown in FIG. 1, the azimuth gear 720 is driven by azimuth drive gear 330 in the direction 332. In the preferred embodiment, the azimuth drive gear 330 has 16 teeth so that the ratio between gear 720 and gear 330 is 6 to 1. The azimuth gear 720, as shown in FIG. 7*b*, has the gear teeth 721 located on an inside circumference. The elevation gear 710, in the preferred embodiment, has 72 teeth 711 and is driven in the direction 352 by elevation drive gear 350 which has 12 teeth. The ratio between gear 710 and 350 is 6 to 1 which precisely equals the aforesaid azimuth gear ratio. The elevation gear 710, as shown in FIG. 7*a*, has the gear teeth 711 located on an inside circumference.

As shown in FIG. 7*b*, the azimuth gear 720 is connected through a circular metal plate 730 to the platform 40. Bolts 722 connect through holes 724 in gear 720 and through holes 726 in plate 730 to hole 832 (FIG. 8) in the platform 40 shown in line 723. Opposing location pins 834 locate the gear 720 on the platform 40 and bolts 722 firmly connect the gear to the platform 40. As gear 720 rotates in direction 732, the platform 40 rotates in direction 140. The bearing 740 has an outer portion 742 and an inner portion 744 separated by a bearing race 746. The outer portion 742 freely rotates about the inner circumference 744 about bearings 746. The bearing 740 is of conventional design. The azimuth gear 720, by means of connectors 722, is firmly held in an abutting relationship against the plate 730 which in turn is firmly held against and in an abutting relationship with the inner portion 744 of the bearing 740. This is shown in FIG. 1. The outer portion 742 is held firmly to the motor support 100 and does not move as it is fixed in relationship to the vessel. As the azimuth gear 720 rotates in the direction 732 inner portion 744 of the bearing 740 rotates in the direction 734.

Figures 8, 9, 10:
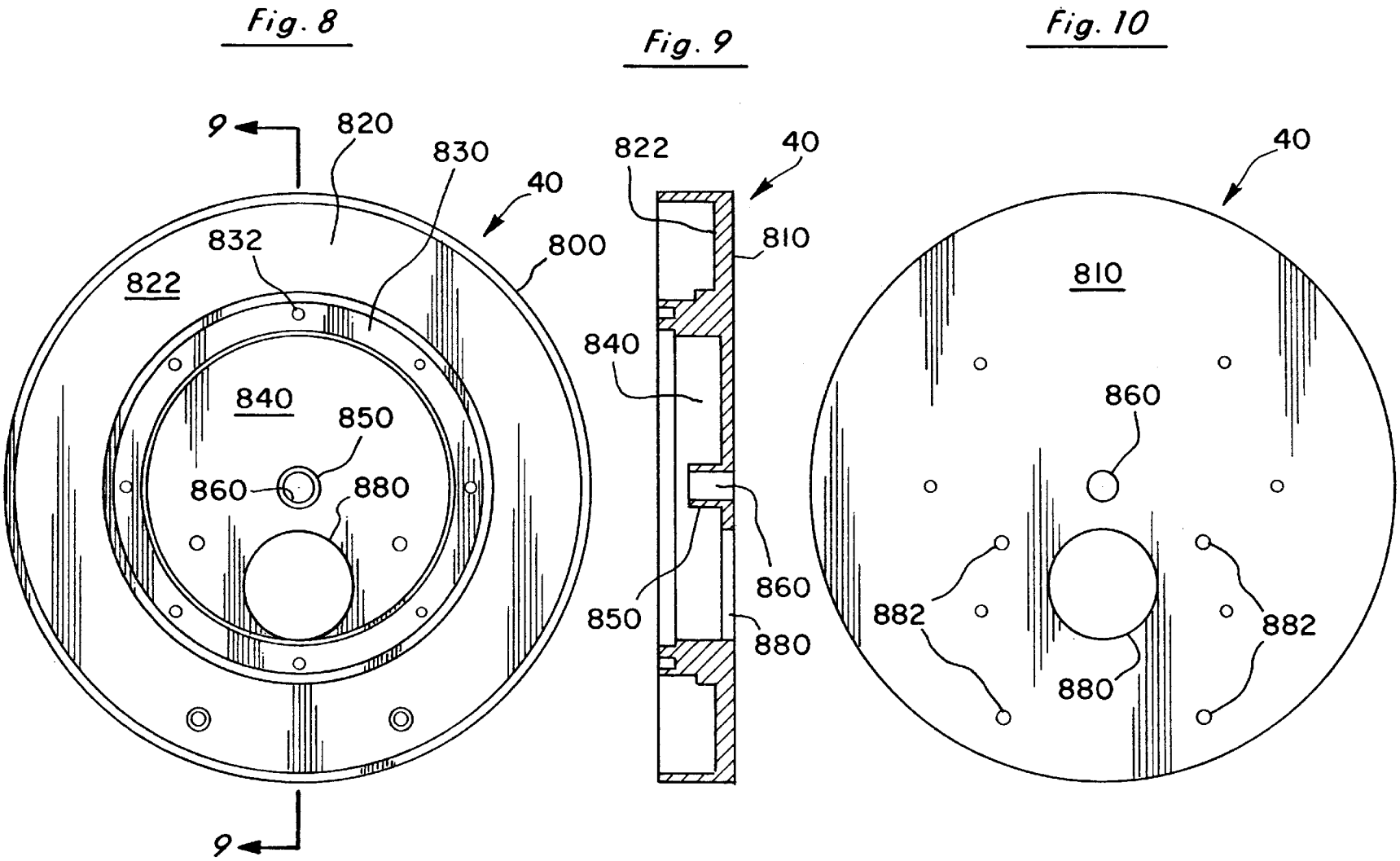
FIG. 8 is a bottom planar view of the platform of the present invention.
FIG. 9 is a cross-section of the platform of FIG. 8 taken along lines 9—9.
FIG. 10 is a top planar view of the platform of FIG. 8.

The details of the platform 40 are shown in FIGS. 8, 9 and 10. Platform 40 has sides 800, an upper surface 810 and a formed annular region 820. An inner ring 830 is formed with a plurality of formed holes 832. As shown in FIGS. 1 and 7, pins 834 and bolts 722 are used to engage the azimuth gear 720 through the gasket 730 to inner ring 830. Hence, and as shown in FIG. 1, as azimuth drive gear 330 rotates in the direction of 332, the platform 40 rotates in the direction of 140. This provides the azimuth movement to the antenna 80.

In FIG. 7*a*, a circular retainer 750 and a circular weathershield 760 are shown. With reference to FIG. 1, the retainer 750 is affixed to the support 100 by bolts 105 as shown in FIG. 2. The outer portion 742 of bearing 740 engages the retainer 750 as shown. Weathershield 760 is provided between the retainer 750 and surface 822 of the platform 40 as shown in FIG. 1. The weathershield 760 prevents contaminants from the environment outside the stabilizer system of the present invention from entering to the interior 32 of the tubular housing 30. Hence, as the azimuth motor 300 causes azimuth drive gear 330 to rotate 332 a corresponding rotation is delivered to the platform 40 as witnessed by arrows 140 and the rotation occurs about the tubular housing 30 which is stationary. Ring 750, weathershield 760 and outer portion 742 of bearing 740 also remain stationary. The inner portion 744 of bearing 740 rotates with the rotation of the platform 40.

As shown in FIGS. 8–10, the platform 40 has an inner annular ring 840 around an upstanding post 850. The center post 850 has a formed opening 860 which passes through the platform 40. The back surface 810 of the platform is flat. The second formed opening 880 is circular in shape and abuts against the inner ring 830 as shown in FIGS. 8–10. Holes 882 are formed in a square pattern about the second formed opening 880 as shown in FIG. 10. This permits the worm gear drive 50 to be mounted to the platform 40. Second formed opening 880 provides a mechanical passageway, as will be explained subsequently, for the elevation drive linkage. The elevation gear 710, as shown in FIG. 1, engages the elevation drive gear 350. The bearing 780 fits around elevation gear 710 as shown in FIGS. 1 and 7*a* with a plate 790 firmly attached over the inner member 784 of bearing 780 and to elevation gear 710 by means of location pins 792 and bolts 794 engaging holes 796. This firmly connects the elevation gear 710 to the inner rotating member 784 of the bearing 780. The outer member 782 can freely rotate about the inner member 784 about bearings. The outer member 782 of the bearing 780 as shown in FIG. 1 is firmly connected to the platform 40. Plate 730 by means of bolts 722 clamps the inner portion 744 of bearing 740 and the outer portion 782 of bearing 780 into position as shown in FIG. 1. Hence, when assembled as shown in FIG. 1, the gear 710 can rotate 712 within the platform 40. Hence, elevation drive gear 350 connected to the elevation motor 310 rotates 352, the gear 710 and plate 790 rotate 712, as shown, independently of the platform 40. At the top of plate 790 about an upstanding collar 796 is affixed a gear 798 which is connected to the plate 790 by means of locating pins 802 and bolts 804. Hence, the rotation 352 of gear 350 causes gear 798 to rotate 795 which in turn causes gear 798 to rotate around opening 860. In the preferred embodiment, gear 798 has 30 teeth.

In summary, the stabilizer platform 10 of the present invention provides an azimuth motor 300 under control of power and signals on cable 301 having its shaft 302 connected to gear 330 which directly engages gear 720 which is coupled to platform 40 to rotate the platform in the azimuth direction 140. Bearing 740 enables the platform 40 to be rotationally connected to the housing 30. It is to be expressly understood that the use of gears 330 and 720 to provide the coupling of motor 300 to platform 40 is only the preferred embodiment and that other equivalent gear arrangements could be used. Further, the use of bearing 740 to provide independent rotation of platform 40 about housing 30 is also the preferred embodiment and that other equivalent bearing structures could be used. The motor 300 provides rotational movement in the azimuth direction 140 for platform 40 (and dish 80) without moving either motor 300 or motor 310 and without entangling or moving cables 301 and 311.

5. Rotary Coaxial Assembly

Figure 3:
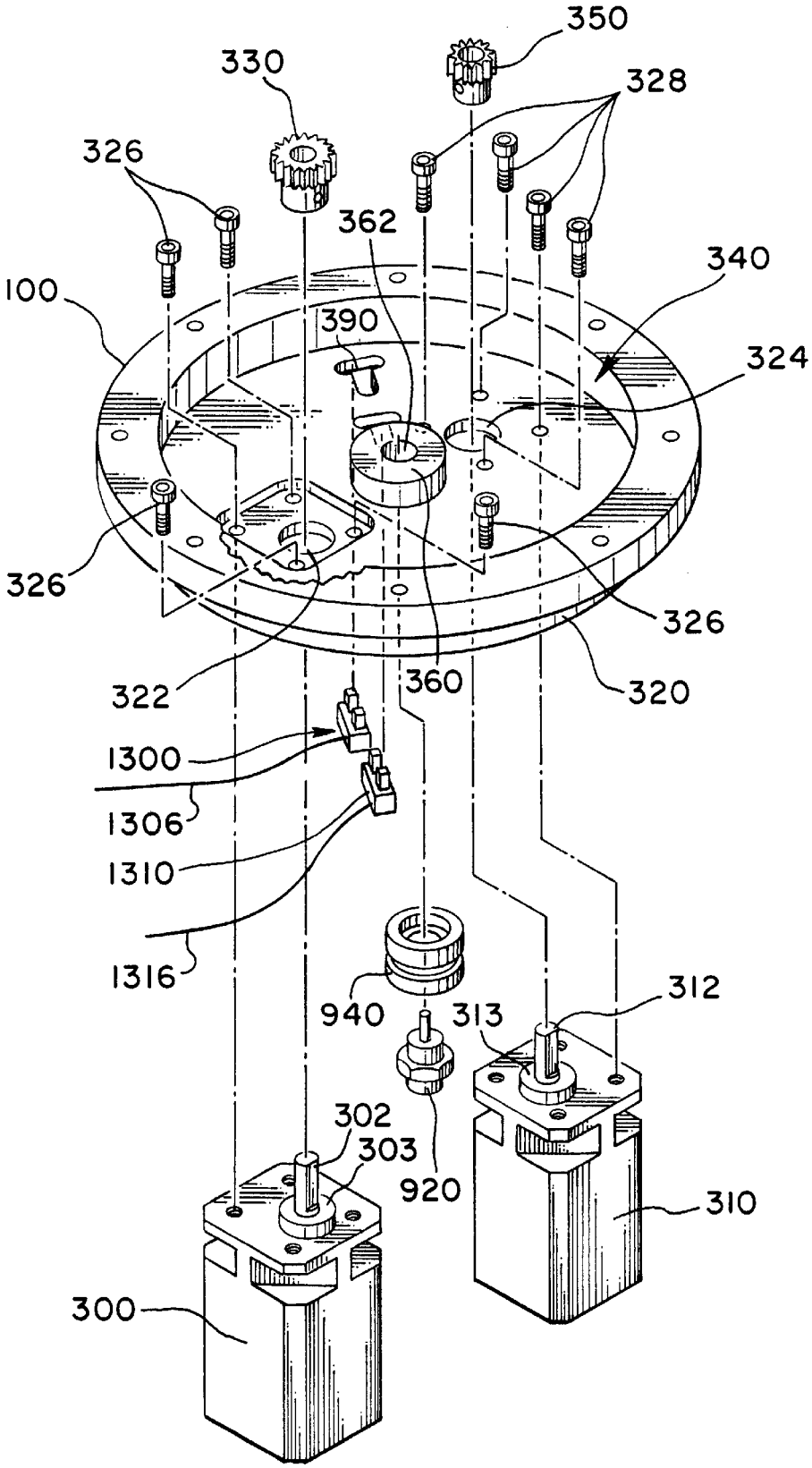
FIG. 3 sets forth an exploded view showing the interconnection of the elevation and azimuth motor support.

The rotary coaxial assembly 900 is shown in FIGS. 1, 3 and 7*a*. The construction of the rotary coaxial assembly 900 is not material to the teachings of the present invention and any suitable rotary coaxial or rotary joint could be utilized under the teachings of the present invention. The rotary coaxial 900 has an upper coaxial connector 910 which rotates with platform 40, a lower coaxial connector 920 which is stationary with the motor support 100, and a rotary joint member 930 which preserves the signal path between cable 911 and 81. A boot 940 is provided between the lower coaxial connector 920 and the motor support 100.

6. Worm Gear Drive

As shown in FIG. 2, the worm gear drive in mounting over a sealing gasket 130 to the upper surface 810 of the platform 40. Bolts 132 pass through holes 882 in the platform 40, through holes 135 in the gasket 130 and into corresponding holes, not shown, in the housing 50. This firmly seals the worm gear drive 50 to platform 40. The details of the housing 50 for the worm gear drive of the present invention is not material. What is important and as illustrated in FIG. 2, is to provide a downwardly extending gear 54 through a formed opening 134 in gasket 130 and through hole 880 in platform 40. What is also important is that the housing 50 provides an outwardly extending shaft 60 on opposing sides of the gear drive 50 in order for the L-mount 66 and cap 64 to connect the dish 80. The shaft 60 is capable of rotating in directions 160. This is better shown in FIG. 1 where gear 54 is shown extending into the region 840 beneath the top 810 of platform 40.

FIG. 12 shows the details of the engagement with the worm gear drive in greater detail. The worm gear drive has worm 1200 and worm gear 1210. Worm 1200 is oriented perpendicular to the platform 40 and has a shaft 1202 which is connected to gear 54. Gear 54 is conveniently attached to shaft 1202. The number of teeth in gear 54 are identical to the number of teeth in gear 798 so that there is preferably a one-to-one gear ratio. However, gear 54 may have less teeth than gear 798 so that gear 54 is of smaller diameter. This smaller diameter enables gear 54 to easily be lowered through formed opening 880 during manufacturing. In reference back to FIG. 7*a*, it is clear that as the elevation gear 710 rotates in direction 712, so does gear 798 rotate in direction 795. Such rotation 795 causes corresponding rotation in gear 54 which is connected to shaft 1202 which causes 1200 to rotate 1204. Worm 1200 has one end 1206 engaging a bearing 1220 in the top 1222 of the housing 50. Hence, end 1206 of gear 1200 freely rotates in the bearing end. The opposite end 1202, as mentioned, is connected to gear 54. However, a bearing 1208 positions end 1202 in the bottom 1224 of the housing 50. Rotation 1204 of worm 1200 causes rotation 160 of gear 1210. Gear 1210 engages bearing races on opposing sides of the housing 50 similar to that shown for bearings 1220 and 1208.

The worm gear arrangement 1200 and 1210 along with gear 54 form an elevation drive which is mounted on the platform 40. While these two gears 1200 and 1210 and gear 54 are used to move the dish 80 in the elevation direction 160 in the preferred embodiment, it is to be expressly understood that any equivalent gearing arrangement could also be used. The elevation drive is connected to the dish 80 and is mounted on the platform 40. The elevation drive and its housing 50 rotates as the platform 40 rotates 140.

The elevation gear drive of the present invention includes the elevation drive (i.e., gears 54, 1200, 1210) mounted on the platform 40. The elevation gear drive moves with platform 40 and the elevation gear cluster does not move with platform 40. The elevation gear cluster includes gears 798, 710, and 350. The elevation gear cluster is rotationally mounted by means of bearing 780 in the platform 40. Bearing 780 permits the dish 80 to be driven independently of the azimuth movement of the platform in the elevation direction. It is to be expressly understood that elevation gear cluster design using gears 798, 710 and 350 is only the preferred embodiment and that other equivalent arrangements could be used. Further, the use of bearing 780 to provide independent rotation within platform 40 is also the preferred embodiment and that other equivalent bearing structures could be used. The motor 310 provides movement of the dish 80 in the elevation direction 160 without moving either motor 300 or motor 310 and without entangling or moving cables 301 and 311.

7. Operation

The operation of the stabilizer platform of the present invention will now be explained. First, the movement of the platform 40 in the azimuth direction 140 will be discussed. Next, the movement of the dish in the elevation direction 160 will be presented. Finally, the simultaneous movement in the azimuth direction 140 as well as in the elevation direction 160 will be presented.

With reference to FIG. 1, the azimuth motor 300 when suitably activated through control signals through cable 301 rotates 332 azimuth drive gear 330. This rotation causes azimuth gear 720 to rotate which immediately causes platform 40 to rotate 140. Essentially, platform 40 is integral with gear 720. Bearing 740 permits the platform 40 to rotate freely. Hence, if azimuth motor 300, for example, is a stepper motor, suitable stepping commands can be delivered over control leads 301 to cause the stepper motor 300 to move the platform in the direction 140.

Assume the elevation of the antenna is to remain at a constant angle. In this mode of operation, the platform 40 can continually rotate in multiple 360 degrees turns in the same direction. In this mode of operation, note that none of the cables 301, 311, 81 become twisted. Indeed, the motors 300 and 310 are firmly fixed in tubular housing 30 and are stationary. To accomplish the maintenance of the dish at a constant elevation during such rotation, the elevator motor would be activated to compensate for the rotation of the platform in the azimuth direction. If the elevation motor was not activated, the dish would raise or lower as the platform rotates in the azimuth direction. The various ratios contained herein for the elevation and azimuth gearing is the preferred embodiment. These ratios, of course, can be appropriately changed to meet other design requirements.

The operation of the elevation motor 310 is also under control of signals in the control leads 311. Again, elevation motor can be a stepper motor. Motor 310 rotates 352 elevation drive gear 350, drive gear 350, in turn, engages elevation gear 710 which causes plate 790 to which gear 798 is firmly affixed to rotate 795. Gear 798 engages gear 54 and provides a corresponding rotation 1204 in worm gear 1200. The rotation of worm gear 1200 causes worm gear 1210 to rotate which causes the axle 60 to move the dish 80 in the direction 160. Hence, individual stepper control signals on control leads 311 to stepper motor 310 cause the dish 80 to be precisely positioned 160 in the elevation direction.

Assume that the azimuth motor 300 is not activated. The azimuth motor can be assumed in this scenario to have positioned the platform 40 at any desired angular position 140. If only the elevation motor 310 is activated, the dish 80 can be moved in the elevation direction 160 through an approximately 90° orientation up and down. This operation is fully independent of the activation of the azimuth motor 300. Bearing 780 enables the elevation gear 710 to freely move with respect to the platform 40.

What has been described above for the azimuth operation and for the elevation operation is singularity of control. In both operations, the cables 301, 311 and 81 do not twist or become entwined.

Because separate control signals are delivered on leads 301 and 311 to motors 300 and 310 effectively, it is to be expressly understood that under the teachings of the present invention, the platform 40 and the shaft 60 can be simultaneously operated to move the dish antennae simultaneously in the azimuth direction 140 and in the elevation direction 160. This provides a rapid orientation of the satellite dish to the target satellite.

8. Initialization

The singularity of control discussed in the prior section, stabilizer system of present invention must have initialization.

In FIG. 13, the motor support 100 is shown with the azimuth slot 390 and the elevation slot 380. In each slot is placed a photosensor. In slot 390 is disposed photosensor 1300 and in slot 380 is disposed sensor 1310. In photosensor 1300 is a formed gap 1302 and in photosensor 1310 is a formed gap 1312. A beam of light 1304 and 1314, respectively, for sensors 1300 and 1310 is generated from a suitable light source to a suitable light detector, not shown.

This technology is conventional and well known. A pin 1320 (see also FIG. 7*b*) is mounted to the azimuth gear 720. Hence, upon initialization of the stabilizer system of the present invention, the elevation motor 300 is activated until pin 1320 breaks the light beam 1304 in sensor 1300. The motor 300 is then stopped. The sensor 1300 is connected to the support 100 which is stationary and control lead 1306 (see FIG. 3) deliver this event outwardly from the housing. This precisely references the mechanical orientation of the platform 40 to the electronics of the system and provides a known starting point.

Likewise, a pin 1330 is provided into the plate 790 (see also FIG. 7*a* which is affixed to elevation gear 710). The elevation motor 310 is activated until pin 1330 breaks the light beam 1314 and sends a signal on lead 1316 (see FIG. 3). The motor 310 is then stopped. In operation, first pin 1320 is aligned by the azimuth motor 300 and upon precise alignment, the elevation motor is activated until pin 1330 is detected.

In this fashion, the stabilizer platform of the present invention is initialized.

The invention has been described with reference to the preferred embodiment. Modifications and alterations will occur to others upon a reading and understanding of this specification. This specification is intended to include all such modifications and alterations insofar as they come within the scope of the appended claims or the equivalents thereof.

I claim:

1. A stabilizer platform mounted on a vessel for continually positioning a satellite dish antenna, said stabilizer platform moving said satellite dish antenna in an azimuth direction and an elevation direction, said stabilizer platform comprising:

a motor support fixedly attached to said vessel;

a platform rotationally assembled to said motor support;

an azimuth motor fixedly attached to said motor support, said azimuth motor coupled to said platform, said platform rotating in said azimuth direction when said azimuth motor is driven;

an elevation gear drive rotationally mounted through said platform, said satellite dish antenna coupled to said elevation gear drive, said satellite dish antenna moving in both said azimuth direction and said elevation direction as said platform is rotated by said azimuth motor;

an elevation motor fixedly attached to said motor support, said elevation motor coupled to said elevation gear drive, said satellite dish antenna only moving in said elevation direction when only said elevation motor is driven;

said stabilizer platform compensating for changes in elevation caused by said rotation of said platform in said azimuth direction by driving said elevation motor.

2. The stabilizer platform of claim 1 wherein said satellite dish antenna is positioned both in the azimuth direction and the elevation direction by simultaneously driving said azimuth motor and said elevation motor.

3. The stabilizer platform of claim 1 further comprising:

a housing affixed to said vessel, said azimuth motor and said elevation motor fixedly mounted within said housing.

4. The stabilizer platform of claim 3 wherein said housing has a formed hollow interior and wherein said azimuth and elevation motors are mounted in said hollow interior.

5. The stabilizer platform of claim 1 wherein said coupling of said azimuth motor to said platform comprises:

said azimuth motor having a shaft;

a first gear axially connected to said shaft;

a second gear engaging said first gear, said second gear having a greater number of teeth than said first gear;

said platform affixed to said second gear.

6. The stabilizer platform of claim 1 wherein said elevation gear drive comprises:

said elevation motor having a shaft;

a first gear axially affixed to said shaft;

a second gear engaging said first gear, said second gear having a greater number of teeth than said first gear;

said second gear rotationally mounted to said platform so that said second gear independently rotates with respect to said platform;

a third gear affixed to said second gear, said third gear having less teeth than said second gear;

a fourth gear engaging said third gear, said fourth gear having the same number of teeth as said third gear;

a first worm gear affixed to said fourth gear;

a second worm gear engaging said first worm gear in a normal relationship, said second worm gear connected to said satellite dish antenna.

7. The stabilizer platform of claim 1 further comprising:

a first pin fixedly attached within said coupling of said azimuth motor to said platform;

a second pin fixedly attached within said elevation gear drive;

said azimuth motor driven until a sensor detects said first pin, then said elevation motor driven until said sensor detects said second pin, thereby initializing said stabilizer platform.

8. A stabilizer platform mounted on a vessel for continually positioning a satellite dish antenna, said stabilizer platform moving said satellite dish antenna in an azimuth direction and an elevation direction, said stabilizer platform comprising:

a motor support fixedly attached to said vessel;

a platform rotationally assembled to said motor support;

an azimuth motor fixedly attached to said motor support, said azimuth motor coupled to said platform, said platform rotating in said azimuth direction when said azimuth motor is driven;

an elevation gear drive rotationally mounted through said platform, said satellite dish antenna coupled to said elevation gear drive, said satellite dish antenna moving in both said azimuth and elevation directions as said platform is rotated by said azimuth motor;

an elevation motor fixedly attached to said motor support, said elevation motor coupled to said elevation gear drive, said satellite dish antenna only moving in said elevation direction when only said elevation motor is driven;

a housing affixed to said vessel, said housing having a formed hollow interior, said azimuth motor and said elevation motor mounted within said formed hollow interior of said housing;

said stabilizer platform compensating for elevation changes caused by said rotation of said platform in said azimuth direction by driving said elevation motor, said satellite dish antenna positioned both in the azimuth direction and the elevation direction by simultaneously driving said azimuth motor and said elevation motor.

9. The stabilizer platform of claim 8 wherein said coupling of said azimuth motor to said platform further comprises:

said azimuth motor having a shaft;

a first gear axially connected to said shaft;

a second gear engaging said first gear, said second gear having a greater number of teeth than said first gear;

said platform affixed to said second gear.

10. The stabilizer platform of claim 8 wherein said elevation gear drive further comprises:

said elevation motor having a shaft;

a first gear axially affixed to said shaft;

a second gear engaging said first gear, said second gear having a greater number of teeth than said first gear;

said second gear rotationally mounted to said platform so that said second gear independently rotates with respect to said platform;

a third gear affixed to said second gear, said third gear having less teeth than said second gear;

a fourth gear engaging said third gear, said fourth gear having the same number of teeth as said third gear;

a first worm gear affixed to said fourth gear;

a second worm gear engaging said first worm gear in a normal relationship, said second worm gear connected to said satellite dish antenna.

11. The stabilizer platform of claim 8 further comprising:

a first pin fixedly attached within said coupling of said azimuth motor to said platform;

a second pin fixedly attached within said elevation gear drive;

said azimuth motor driven until a sensor detects said first pin, then said elevation motor driven until said sensor detects said second pin, thereby initializing said stabilizer platform.

12. A stabilizer platform mounted on a vessel for continually positioning a satellite dish antenna, said stabilizer platform moving said satellite dish antenna in an azimuth direction and an elevation direction, said stabilizer platform comprising:

a motor support fixedly attached to said vessel;

a circular shaped platform rotationally assembled above said motor support;

an azimuth motor fixedly attached to said motor support, said azimuth motor coupled to said circular shaped platform, said circular shaped platform rotating in said azimuth direction when said azimuth motor is driven, said coupling having:

an azimuth gear;

an azimuth shaft;

a first azimuth gear axially connected to said azimuth shaft;

a second azimuth gear engaging said first azimuth gear, said second azimuth gear having a greater number of teeth than said first azimuth gear;

said circular shaped platform affixed to said second azimuth gear;

an elevation gear drive rotationally mounted through said circular shaped platform, said satellite dish antenna coupled to said elevation gear drive, said satellite dish antenna moving in both said azimuth and elevation directions as said circular shaped platform is rotated by said azimuth motor, said elevation gear drive having:

a plate affixed to an elevation gear;

an elevation shaft;

a first elevation gear axially affixed to said elevation shaft;

a second elevation gear engaging said first elevation gear, said second elevation gear having a greater number of teeth than said first elevation gear;

said second elevation gear rotationally mounted to said circular shaped platform so that said second elevation gear independently rotates with respect to said circular shaped platform;

a third elevation gear affixed to said second elevation gear, said third elevation gear having less teeth than said second elevation gear;

a fourth elevation gear engaging said third elevation gear, said fourth elevation gear having the same number of teeth as said third elevation gear;

a first worm gear affixed to said fourth elevation gear;

a second worm gear engaging said first worm gear in a normal relationship, said second worm gear connected to said satellite dish antenna;

an elevation motor fixedly attached to said motor support, said elevation motor coupled to said elevation gear drive, said satellite dish antenna only moving in said elevation direction when only said elevation motor is driven;

a cylindrical and weather-sealed housing having a formed hollow interior surrounding said motor support, said azimuth motor and said elevation motor mounted within said formed hollow interior of said cylindrical and weather-sealed housing;

a first pin fixedly attached to said azimuth gear;

a second pin fixedly attached to said plate affixed to said elevation gear;

a first photosensor and a second photosensor, said azimuth motor driven until said first photosensor detects said first pin, then said elevation motor driven until said second photosensor detects said second pin, thereby initializing said stabilizer circular shaped platform;

said stabilizer platform compensating for elevation changes caused by said rotation of said platform in said azimuth direction by driving said elevation motor, said satellite dish antenna positioned both in the azimuth direction and the elevation direction by simultaneously driving said azimuth motor and said elevation motor.

* * * * *

UNITED STATES PATENT AND TRADEMARK OFFICE

CERTIFICATE OF CORRECTION

PATENT NO. : 6,023,247
DATED : February 8, 2000
INVENTOR(S) : Rodeffer

It is certified that error appears in the above-indentified patent and that said Letters Patent is hereby corrected as shown below:

Column 3, line 20, before "housing" insert --the--

Column 7, line 36, replace "gasket 730" with --plate 730--

Column 7, line 40, replace "Fig. 7a" with --Fig. 7b--

Column 9, line 20, after "causes" insert --worm--

Figure 2, reference the holes formed in plate 130 as --135--

Figure 2, delete reference "132" from the edge of gasket 130

Figure 11, reference connectors connecting bracket 70 to dish 80 as --72--

Signed and Sealed this

Ninth Day of January, 2001

*Attest:*

Q. TODD DICKINSON

*Attesting Officer*

*Commissioner of Patents and Trademarks*